United States Patent [19]

Lohmann

[11] 4,036,778

[45] July 19, 1977

[54] AQUEOUS, STORAGE-STABLE DISPERSIONS OF WATER-SOLUBLE COMPOUNDS

[75] Inventor: Frank Lohmann, Arlesheim, Switzerland

[73] Assignee: Ciba-Geigy Corporation, Ardsley, N.Y.

[21] Appl. No.: 655,813

[22] Filed: Feb. 6, 1976

[30] Foreign Application Priority Data

Feb. 28, 1975 Switzerland ..... 2564/75

[51] Int. Cl.[2] ..... D06L 3/12; C09K 11/00

[52] U.S. Cl. ..... 252/301.21

[58] Field of Search ..... 252/301.21–301.32; 424/173

[56] References Cited

U.S. PATENT DOCUMENTS

| | | | |
|---|---|---|---|
| 3,360,479 | 12/1967 | Hausermann | 252/301.23 |
| 3,496,112 | 2/1970 | Goldwasser et al. | 252/301.21 X |
| 3,595,801 | 7/1971 | Roshch et al. | 252/301.24 |
| 3,689,429 | 9/1972 | Deubel et al. | 252/301.23 |
| 3,767,587 | 10/1973 | Claussen et al. | 252/301.23 |
| 3,900,608 | 8/1975 | Dierkes et al. | 427/158 |
| 3,904,544 | 9/1975 | Clark et al. | 252/301.21 |

FOREIGN PATENT DOCUMENTS

| | | |
|---|---|---|
| 1,197,520 | 7/1970 | United Kingdom |

*Primary Examiner*—John H. Mack
*Assistant Examiner*—Aaron Weisstuch
*Attorney, Agent, or Firm*—Karl F. Jorda; Edward McC. Roberts; Parbodh I. Almaula

[57] ABSTRACT

New aqueous storage-stable dispersions of water-soluble compounds, which dispersion is free from organic solvent and which comprises a) a water-soluble anionic or cationic compound, b) at least one water-soluble salt, c) at least one stabilizing agent and d) water and wherein the salt concentration is high enough to ensure that the water-soluble compound remains essentially undissolved as well as a process for producing said dispersions are described.

5 Claims, No Drawings

AQUEOUS, STORAGE-STABLE DISPERSIONS OF WATER-SOLUBLE COMPOUNDS

The present invention relates to new aqueous, storage-stable dispersions of water-soluble compounds, which dispersions contain no organic solvents, to a process for producing these dispersions, as well as to their use for the finishing of natural or synthetic organic materials.

Compared with solid commercial preparations, liquid commercial preparations have the advantages of being free from dust, of being easy to dispense in controlled amounts, and of not having the low rate of dissolving that solid commercial preparations frequently have. Water-soluble compounds are therefore being applied, as liquid commercial preparations, to an ever increasing extent for the finishing of natural or synthetic organic materials.

The producing of liquid commercial preparations of water-soluble optical brighteners, or of other textile-treatment agents, in the form of solutions is known. It is however possible only in the case of readily soluble compounds, such as are described in the British Pat. Specifications Nos. 986,338 and 1,000,825, to produce purely aqueous solutions in concentrated form. In general it is necessary to increase the solubility of, for example, water-soluble brighteners in the commercial form by adding water-miscible organic solubility-promoting agents, such as mono- or polyvalent alcohols or ethers thereof, or polar compounds such as dimethylsulphoxide, dimethylformamide or lactones. Such aqueous solutions are described in the British Pat. Specification No. 930,393.

The disadvantages of solutions as liquid commercial preparations are the attainment frequently of only a low concentration of active substance, the critical storage stability and the high addition of organic solubility-promoting agents, which are not consumed on application and which lead to an additional ecological contamination of the exhaust air and/or of the waste-liquor.

In the British Pat. Specification No. 1,250,207, there are described liquid commercial preparations of optical brighteners, which preparations are produced by dispersion of the brightener in water-miscible polyvalent alcohols and/or in ethers thereof, and/or in water-soluble polyethers, with the exclusion of water. Compared with the solutions previously mentioned, these commercial preparations have the advantage that in most cases high concentrations of optical brighteners are obtained and that crystallisation effects are avoided. However, the disadvantage of the ecological contamination of the exhaust-air and/or of the waste-liquor is still present on account of the use of the described organic compounds.

Even with application of dispersing agents, aqueous dispersions of water-soluble compounds are normally but stable since there occur, as a result of the solubility of the water-soluble compounds, dissolving and crystallising processes which lead to an uncontrolled growth of the dispersed particles of the water-soluble compound; and this in turn gives rise to an accelerated rate of sedimentation. In addition, the increasing size of the dispersed particles of the water-soluble compound causes a decreasing rate of dissolving of the dispersion on application. In general, the solubility of water-soluble brighteners can be lowered by the addition of salts of strong acids and bases, such as sodium chloride, potassium chloride, sodium sulphate, etc., to the aqueous dispersion medium. As is known however from the text-books of physical chemistry and of colloid chemistry, the stability of dispersions is greatly reduced as a result of these salts.

There have now been found new water-soluble, storage-stable, more highly concentrated dispersions of water-soluble compounds, which dispersions are free from organic solvents, are obtainable in a simple manner, and do not have the disadvantages mentioned above.

These novel, water-soluble, storage-stable dispersions are characterised in that they contain a. a water-soluble anionic or, preferably, cationic compound, b. at least one water-soluble salt consisting of the anion of an inorganic or organic, mono- or polybasic acid and the cation of an inorganic, mono- or polyacid base, c. at least one stabilising agent based on
one or more nonionic water-soluble polymers,
one or more nonionic, surface-active compounds, or
mixtures thereof, optionally with the addition of one or more ionic surface-active compounds, and d. water, and that the salt concentration is high enough to ensure that the water-soluble compound remains essentially undissolved.

By "essentially undissolved" is meant that the water-soluble compound is dissolved at most to the extent of 1 percent by weight.

By water-soluble, anionic or cationic compounds for the finishing of natural or synthetic organic materials are meant fungicides or bactericides, such as quaternised ammonium compounds with longer-chain alkyl radicals, as well as optical brighteners which contain water-solubilising groups and which are from the classes of triazinylamino-stilbenes, v-triazolyl-stilbenes, distyrylbiphenyls and distyryl-benzenes, stilbenyl-naphthotriazoles, benzoxazolyl-stilbenes, bis-benzoxazoles, momo- and bisbenzimidazoles, pyrazolines, benzofurans or naphthalimides, such as the sodium salt of 4,4'-bis-(4-anilino-6-diethanolamino-1,3,5-triazin-(2)-yl-amino)-stilbene-2,2'-disulphonic acid, the sodium salt of 4,4'-bis-(4-phenyltriazol-(2)-yl)-stilbene-2,2'-disulphonic acid, the disodium salt of 4-(6'-sulphonaphtho-(1',2':4,5)-1,2,3-triazol-(2)-yl)-2-sulphostilbene, the disodium salt of 4,4'-bis-(3-sulpho-4-chlorostyryl)-biphenyl, 1,4-bis-(4-sulpho-styryl)-benzene, the sodium salt of 4-phenyl-4'-(5-sulphobenzoxazole-(2)-yl)-stilbene, 2,5-bis-(5-sulpho-benzoxazol-(2)-yl)-thiophene, 2-(6-methoxybenzofur-(2)-yl)-1-benzyl-3-methyl-benzimidazolium chloride, 1-(4-sulphophenyl)-3-(4-chlorophenyl)-5-phenyl-pyrazoline or 4-methoxy-N-dimethylaminopropyl-1,8-naphthalimide in its quaternised form.

The anions of water-soluble salts usable according to the invention are derived principally from inorganic mono- or polybasic mineral acids, for example from hydrochloric acid or hydrobromic acid, from nitric acid or from sulphuric acid. They can however be derived also from organic mono- or polybasic, optionally substituted, carboxylic acids. These are, in particular, lower aliphatic monocarboxylic acids optionally substituted, e.g., hydroxyl-substituted, lower aliphatic di- and tricarboxylic acids optionally substituted by hydroxyl groups, and monocyclic-aromatic monocarboxylic acids. Suitable anion-donors are in the case of lower fatty acids for example formic, acetic and glycolic acid; in the case of unsubstituted dicarboxylic acids for example oxalic, malonic, succinic, maleic, fumaric, flutaric and adipic acid; and in the case of di- and tricarboxylic acids substituted by hydroxyl groups for example tartaric and citric acid. Suitable anions of mononuclear aromatic carboxylic acids are, for example, those of benzoic, chlorobenzoic, methylbenzoic and salicylic acid.

Suitable cations of water-soluble salts usable according to the invention are alkali metal ions, such as sodium or potassium ions, ammonium ions, mono-, di- and trialkyl-ammonium ions or alkaline-earth metal ions such as the ions of magnesium or calcium.

As water-soluble salts of inorganic or organic polybasic acids, it is possible to use according to the invention also the acid salts thereof. However, the neutral salts are preferred. Examples of suitable inorganic salts are, in particular, the neutral alkali metal, ammonium or alkaline-earth metal salts of strong inorganic mono- or polybasic acids, such as sodium, potassium and ammonium chloride; magnesium or calcium chloride; sodium bromide, potassium bromide and ammonium bromide; sodium nitrate, potassium nitrate and ammonium nitrate; sodium sulphate, potassium sulphate and ammonium sulphate; sodium phosphate, potassium phosphate and ammonium phosphate, or mixtures thereof. Examples of suitable salts of organic acids are, in particular, the alkali metal salts of lower fatty acids, especially sodium and potassium acetate, sodium and potassium citrate and sodium and potassium tartrate. Particularly preferred are water-soluble neutral alkali metal salts or ammonium salts of strong inorganic mono- or polybasic acids, especially sodium chloride.

Suitable nonionic water-soluble polymers which in such solutions are not salted out at temperatures of below 20° to 40° C are, for example, polyvinyl alcohol, polyvinylpyrrolidone, hydroxyethylcellulose, hydroxypropyl-cellulose, or copolymers from polyvinylacetate and polyvinylpyrrolidone. The water-soluble polymers can be used on their own, or in admixture with nonionic and/or ionic surface-active compounds.

The following can be used as nonionic surface-active substances:

1. Addition products of alkylene oxides, particularly of ethylene oxide, with higher fatty acids, fatty acid amides, aliphatic alcohols, mercaptans or amines, or with alkylphenols or alkylthiophenols, the alkyl radicals of which contain at least 7 carbon atoms. Preferred addition products are polyglycol-(monoalkyl-phenyl)-ethers, the alkyl group of which contains 8 to 12 carbon atoms, with at least 8 optionally substituted glycol units, such as decaethylene glycol-mono-octylphenyl ether, or the reaction product of monononylphenol with 35 moles of ethylene oxide.

2. Block polymers from ethylene oxide and higher alkylene oxides, such as propylene oxides or butylene oxide.

3. Nonionic esters of the addition products of alkylene oxides, such as the tertiary phosphoric acid ester of the addition product of 40 moles of ethylene oxide with monononyl-phenol.

4. Esters of polyalcohols, particularly monoglycerides of fatty acids with 12 to 18 carbon atoms, e.g., the monoglycerides of lauric, stearic or oleic acid.

5. N-acylated alkanolamines of the same type as that mentioned in the case of the sulphates of these compounds, thus, e.g., the N,N-bis-($\omega$-hydroxyalkyl)-amides of the mixtures of acids known under the collective term of "coconut oil fatty acids", especially N,N-bis-($\beta$-hydroxyethyl)- or N,N-bis-($\gamma$-hydroxypropyl)-amides; also the addition products of ethylene oxide with these N-acylated alkanolamines.

6. Reaction products from higher fatty acids with an alkanolamine, whereby the molar ratio of alkanolamine to fatty acid is greater than 1, e.g., 2. Suitable fatty acids are, in particular, those having 8 to 18 carbon atoms, as well as the mixtures designated as coconut oil fatty acids; and a suitable alkanolamine is, in particular, diethanolamine.

If the stabiliser system used to stabilise the dispersions contains ion-active surface-active agents, then in general the surface-active agents should have the same charge as that contained by the water-solubilising groups of the compound to be dispersed.

Examples of anion-active surface-active agents usable according to the invention for stabilisation of the dispersion are as follows:

1. Sulphated alkylene oxide adducts, particularly sulphated ethylene oxide adducts, such as sulphated addition products of 1 to 40 moles of ethylene oxide with fatty acid amides, mercaptans or amines, especially however with fatty acids, aliphatic alcohols or alkylphenols having 8 to 20 carbon atoms in the alkyl chain, e.g., with stearic acid, oleic acid, lauryl alcohol, myristyl alcohol, stearyl alcohol, oleyl alcohol, octyl phenol or nonyl phenol.

Instead of the sulphates, it is possible to use also the esters of other polyvalent acids. These include, e.g., the primary and secondary esters of phosphoric acid, as well as the semi-esters of sulphosuccinic acid.

2. Sulphated N-acylated alkanolamines, e.g., the sulphated amides of caprylic, pelargonic, caprinic, lauric, myristinic or stearic acid, or of lower fatty acids substituted by alkylphenoxy groups, such as octyl- or nonylphenoxyacetic acid, with mono- or bis-hydroxyalkylamines, such as $\beta$-hydroxyethylamine, $\gamma$-hydroxypropylamine, $\gamma$-hydroxypropylamine, $\beta,\gamma$-dihydroxypropylamine, bis-($\beta$-hydroxyethyl)-amine, or with N-alkyl-N-hydroxyalkyl-amines such as N-methyl- or N-ethyl-N-($\beta$-hydroxyethyl)-amine. 3. Sulphated esterified polyoxy compounds, e.g., sulphated Sulphated partially esterified polyvalent alcohols, such as the sodium salt of the sulphated monoglyceride of palmitic acid.

The following may be mentioned as cation-active surface-active agents usable according to the invention:

1. Ethoxylated ammonium salts of mono- and dialkylamines having an alkyl chain of preferably 10 to 18 carbon atoms.

2. Amines and, in particular, polyamines which contain two or more basic nitrogen atoms, preferably 2 to 5 partially or completely quaternised nitrogen atoms, a polyglycol ether chain and at least one lipophil substituent. In the case of the polyamines, these are, in particular, polyalkylenepolyamine compounds, the alkylene constituents of which consist preferably of 1,2-ethylene groups or of 1,2- or 1,3-propylene groups, for example diethylenetriamine, triethylenetetramine, tetraethylenepentamine or dipropylenetriamine compounds. As lipophil substituent, a nitrogen atom of these polyamides bears an alkyl, alkenyl or acyl radical having in particular 10 to 20 carbon atoms. Examples of such radicals are the tetradecyl, hexadecyl, octadecyl or eicosyl radical, or the oleyl, myristoyl, lauroyl, palmitoyl, stearoyl or oleoyl radical. Polyglycol ether chains of polyamines usable according to the invention contain 3 to about 100, preferably however about 10 to 50 alkyleneoxy groups, principally ethyleneoxy groups, of which isolated ones can be C-alkyl- or C-aryl-substituted.

The proportion of water-soluble compound in dispersions according to the invention is to be as high as possible and is at least about 5% and preferably 10 to 50%. The upper limit is governed by the requirement that the preparations remain flowable.

The salt content in the dispersion is to be made at least high enough to ensure that the water-soluble compound is present essentially in the undissolved state. The minimum content required for the production of stable dispersions according to the invention depends on the one hand on the water-solubility of the compound used and, on the other hand, on the capacity of the employed salt to salt out the water-soluble compound. The optimum salt concentration is determined empirically. The most important test criterion is the degree of prevention of crystallisation or recrystallisation of the water-soluble compound, during storage, as a function of the salt content on application of the respective stabiliser system, whereby the salt concentration used is to be no higher than that required for the obtainment of storage stability, in order to thus avoid difficulties with respect to the solubility of the preparations when diluted with water. In certain cases, a salt concentration of 0.5% is sufficient. The preparations of the invention have a salt content preferably of 1 to 15%.

For the preparation of the dispersion according to the invention, the water-soluble compound is incorporated into the dispersion medium advantageously as moist suction-filter cake or as moist press cake, or in the dried form. The dispersion medium consists of the aqueous salt solution, which contains a part or the whole amount of the stabiliser system in the dissolved state. The incorporation of the water-soluble compound is effected with the use of conventional mixing devices, such as normal stirrers, high-speed stirrers, dissolvers, homogenisers or kneaders. Depending on the particle size in which the water-soluble compound is present after the dispersing process, it is advisable in some cases to follow the dispersing process with a grinding process. The optimum particle size of the dispersion is governed by the requirements with regard to the storage-stability of the dispersion. High levels of storage stability are obtained with readily flowable dispersions having a particle size of about 0.5 to 10 μm. If there are produced from the dispersions, for application, liquors having such high concentrations of the water-soluble compound that only a part of the compound is in the dissolved form, the remainder being present in the form of a dispersion, then it is recommended that there be produced by grinding dispersions which have a maximum particle size not exceeding 3 to 5 μm, in order to thus avoid filtration effects on application.

Depending on the viscosity of the commercial preparation and on its content of water-soluble compound, it may be advantageous to add during dispersion and possible grinding of the water-soluble compound only a part of the stabilisers and salts to be contained in the commercial preparation, and to perform grinding of the water-soluble compound at a concentration higher than that desired in the commercial preparation. The adjustment to the composition required in the commercial preparation is then made after dispersion, or after dispersion and grinding, of the water-soluble compound.

The dispersions according to the invention possess a good storage stability. The compound dispersed therein either produces no sedimentation at all, or it produces a very slight sedimentation which can be easily removed by simple stirring or shaking, so that the compound is again homogeneously dispersed. Depending on the type and on the amount of the employed salt, the dispersions have a freezing temperature which is far below 0° C. Even if during storage the temperature does fall below the freezing temperature, the preparations after thawing out are again in the original storage-stable form.

The dispersions according to the invention constitute ready-to-use preparations that satisfy the requirements of easy dispensability, freedom from dust, and high rate of dissolving on application. According to the type of compound used and its concentration in the dispersion of the invention, there are obtained, on dilution of the preparations with water, liquid mixtures in the form of solutions or liquors, wherein a proportion of the active substance is in the dissolved form and the remainder of the active substance is in the dispersed form. Such liquors can be used directly for the treatment of organic materials, especially fibre material made from natural and regenerated cellulose, wool, polyamide, polyacrylonitrile or modacrylonitrile.

By dilution of the preparations with water, there are obtained stable liquors or, with the employment of thickeners, stable pastes which are very suitable for use in continuous application processes.

The following Examples illustrate the invention.

EXAMPLE 1

1000 parts of a 10% solution of a polyvinyl alcohol are introduced, with stirring, into a solution of 167 parts of sodium chloride in 1170 parts of water. The polyvinyl alcohol is characterised by a hydrolysis degree of 88±1% and by the viscosity of its 4% solution of 20–24 cP at 20° C.

There are afterwards added to the resulting solution 1000 parts of the brightener.

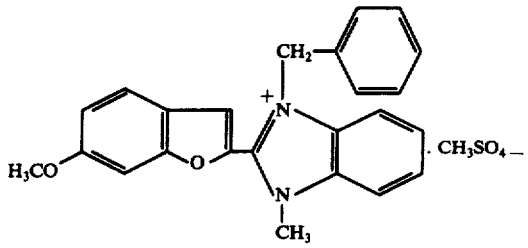

to obtain a coarsely-dispersed dispersion. This is ground in a glass-ball mill, in a manner known per se, until the brightener has a mean particle size of 1–3 μ. A further 83 parts of sodium chloride are then added, with stirring, to the dispersion; there are subsequently also added 55 parts of water as well as 25 parts of a 37% aqueous solution of formaldehyde. After completed dissolving of the sodium chloride, there are added a further 1500 parts of the described 10% solution of polyvinyl alcohol to thus obtain a storage-stable dispersion of the optical brightener. Clear application solutions are obtained by dilution with warm water.

EXAMPLE 2

350 parts of the brightener from Example 1 are dispersed in 650 parts of a dispersion medium containing 6.15% of polyvinyl alcohol and 7.7% of sodium chloride. The polyvinyl alcohol has the same specification as that of the product used in Example 1. The dispersion obtained is afterwards ground in a sand mill until the brightener has a mean particle size of 1 to 4 μ. A readily flowable and storage-stable dispersion is obtained. According to the concentration required on application, there can be produced from the dispersion, by dilution with cold or warm water, clear application liquors

EXAMPLE 3

200 parts of the brightener

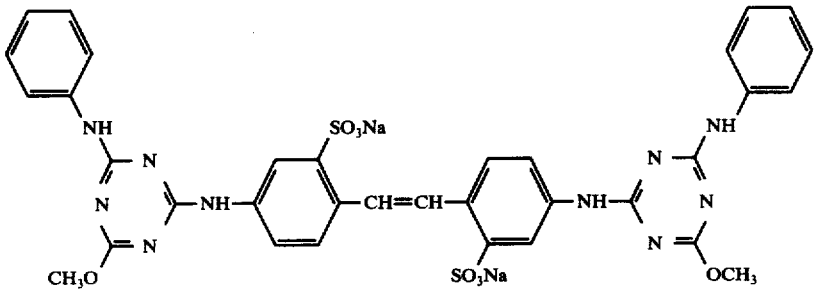

are dispersed in 800 parts of a dispersion medium containing 5% of polyvinyl alcohol, 6.25% of sodium chloride and 5% of an addition product of 35 moles of ethylene oxide with one mole of stearyl alcohol (hydrolysis degree 81.5%; viscosity of the 4% solution at 20° C = 4 cP). The resulting mixture is ground in a glass-ball mill until the optical brightener has attained a mean particle size of 1 to 3 μ. There is obtained a storage-stable and easily pourable dispersion which gives, when hot water is poured into it, clear solutions ready for application.

EXAMPLE 4

A dispersion of 200 parts of the brightener

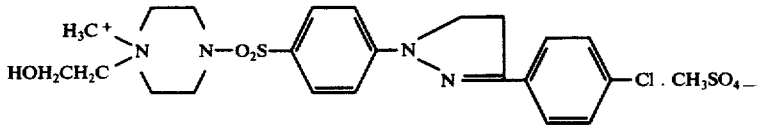

in 800 parts of a dispersion medium containing, per 100 parts, 37.5 parts of polyvinyl alcohol and 6.25 parts of sodium chloride is ground in a glass-ball mill until the active substance has a mean particle size of 1 to 3 μ. There is obtained a good storage-stable formulation which gives, when warm water is poured into it, clear application solutions. The polyvinyl alcohol used has the same specification as that of the product described in Example 1.

The dispersions obtained according to Examples 2 to 4 can be stabilised against bacterial invasion by the addition of 0.5 part of a 37% formaldehyde solution per 100 parts of dispersion.

What is claimed is:

1. An aqueous storage-stable dispersion of a water-soluble optical brightener, which dispersion is free from organic solvents, and which comprises a. a water-soluble anionic or cationic organic optical brightener selected from triazinylamino-stilbenes, v-triazolyl-stilbenes, distyryl-biphenyls, stilbenyl-naphthotriazoles, benzoxazolyl-stilbenes, bis-benzoxazoles, bis-benzimidazoles, pyrazolines, naphthalimides, benzofurans and distyrylbenzenes, b. at least one water-soluble salt consisting of the anion of an inorganic or organic, mono- or polybasic acid and the cation of an inorganic, mono- or polyacid base, c. at least one organic stabilising agent based on one or more nonionic water-soluble polymers, one or more nonionic, surface active compounds, or mixtures thereof, and d. water, and wherein the salt concentration is high enough to insure that the water-soluble optical brightener remains essentially undissolved.

2. Dispersion according to claim 1, wherein the optical brightener is in a crystalline form.

3. Dispersion according to claim 1, wherein the salt consists of the anion of a monobasic inorganic acid and the cation of a monoacid inorganic base.

4. Dispersion according to claim 3, wherein there is used, as stabilising agent, polyvinyl alcohol, polyvinylpyrrolidone, hydroxyethylcellulose, hydroxypropylcellulose, or a copolymer from polyvinyl acetate and polyvinylpyrrolidone, as such or in combination with non-ionic surface-active compounds.

5. A process for the production of an aqueous storage-stable dispersion of a water soluble optical brightener, which dispersion is free from organic solvents, which process comprises homogenising a. a water-soluble anionic or cationic organic optical brightener selected from triazinylamino-stilbenes, v-triazolyl-stilbenes, distyryl-biphenyls, stilbenyl-naphthotriazoles, benzoxazolyl-stilbenes, bis-benzoxazoles, bis-benzimidazoles, pyrazolines, naphthalimides, benzofurans and distyrylbenzenes, b. at least one water-soluble salt consisting of the anion of an inorganic or organic, mono- or polybasic acid and the cation of an inorganic, mono- or polyacid base, c. at least one organic stabilising agent based on one or more nonionic water-soluble polymers, one or more nonionic, surface active compounds, or mixtures thereof, and d. water, and wherein the salt concentration is high enough to insure that the water-soluble optical brightener remains essentially undissolved.

* * * * *